US009259850B2

(12) United States Patent
Hendrickson et al.

(10) Patent No.: US 9,259,850 B2
(45) Date of Patent: Feb. 16, 2016

(54) ROLLING GUIDE FOR TABLE SAW

(75) Inventors: Eric Hendrickson, Palatine, IL (US); Juergen Wiker, Schaumburg, IL (US); Brian Taylor, Chicago, IL (US)

(73) Assignee: Robert Bosch GmbH, Stuttgart, DE (US)

( * ) Notice: Subject to any disclaimer, the term of this patent is extended or adjusted under 35 U.S.C. 154(b) by 544 days.

(21) Appl. No.: 13/343,785

(22) Filed: Jan. 5, 2012

(65) Prior Publication Data

US 2013/0174705 A1 Jul. 11, 2013

(51) Int. Cl.

*B27B 11/02* (2006.01)
*B27B 27/02* (2006.01)
*B27B 27/10* (2006.01)

(52) U.S. Cl.

CPC ..... *B27B 27/02* (2013.01); *B27B 27/10* (2013.01); *Y10T 83/735* (2015.04)

(58) Field of Classification Search

CPC ..... Y10T 83/735
USPC ..... 83/438–468.94; 269/74, 72; 144/286.1, 144/287

See application file for complete search history.

(56) References Cited

U.S. PATENT DOCUMENTS

| | | | | |
|---|---|---|---|---|
| 2,966,179 | A | 12/1960 | Gaskell | |
| 4,206,910 | A | 6/1980 | Biesemeyer | |
| 4,696,213 | A | 9/1987 | Conneally | |
| 5,524,514 | A * | 6/1996 | Hadaway et al. | 83/76.9 |
| 6,357,328 | B1 * | 3/2002 | Ceroll et al. | 83/477.2 |
| 6,360,641 | B1 * | 3/2002 | Talesky et al. | 83/438 |
| 6,918,329 | B2 | 7/2005 | Dick | |
| 8,234,959 | B2 * | 8/2012 | Janson | 83/438 |
| 8,240,237 | B2 * | 8/2012 | Frolov | 83/446 |
| 8,312,799 | B2 * | 11/2012 | Frolov | 83/438 |
| 2004/0107813 | A1 * | 6/2004 | Hewitt et al. | 83/446 |
| 2004/0226425 | A1 * | 11/2004 | Hewitt et al. | 83/446 |
| 2004/0231483 | A1 * | 11/2004 | Hewitt et al. | 83/446 |
| 2004/0261591 | A1 | 12/2004 | Liao et al. | |
| 2005/0087049 | A1 | 4/2005 | Miller et al. | |
| 2008/0284081 | A1 * | 11/2008 | Smith | 269/74 |
| 2009/0146354 | A1 * | 6/2009 | Metroyanis | 269/43 |
| 2009/0272239 | A1 * | 11/2009 | Boehme | 83/13 |
| 2010/0071521 | A1 | 3/2010 | Hadaway et al. | |
| 2010/0269657 | A1 | 10/2010 | Koegel et al. | |
| 2011/0017040 | A1 * | 1/2011 | Folov | 83/446 |

(Continued)

FOREIGN PATENT DOCUMENTS

EP 1787774 5/2007

OTHER PUBLICATIONS

International Search Report in corresponding PCT application (i.e., PCT/US2013/020144), completed May 23, 2013 (10 pages).
INCRA TSLS, Owner's Manual, 2003, Taylor Design Group, Inc., Dallas Texas, US.

(Continued)

*Primary Examiner* — Omar Flores Sanchez
(74) *Attorney, Agent, or Firm* — Maginot Moore & Beck LLP

(57) ABSTRACT

A guide assembly in one embodiment includes at least one guide rigidly supported by a table saw, a bearing assembly including a first, a second, and a third bearing engaged with the at least one guide, and a fence base assembly supported by the bearing assembly, wherein the first and the second bearings are biased in a first direction with respect to the at least one guide and the third bearing is biased in a second direction with respect to the at least one guide, the second direction at least partially opposite to the first direction.

13 Claims, 8 Drawing Sheets

(56) References Cited

U.S. PATENT DOCUMENTS

2011/0048201 A1* 3/2011 Frolov ..... 83/446
2011/0061508 A1* 3/2011 Scherl ..... 83/438

OTHER PUBLICATIONS

DeWalt DW745 Table Saw Parts Diagram, downloaded from http://www.ereplacementparts.com/dewalt-dw745-type-table-saw-parts-c-1009__2657__3819.html on Jan. 5, 2012.

* cited by examiner

ROLLING GUIDE FOR TABLE SAW

FIELD OF THE INVENTION

The present invention relates generally to power saws, and particularly to material guides or fences that accurately direct material past the cutting instrument.

BACKGROUND

The typical table saw includes a cutting instrument, usually a saw blade, attached to a motor mounted beneath a work surface, commonly called a table. The table has an opening that allows a portion of the blade to extend therethrough. To make a cut, a user places material on the table and directs the material through the rotating blade. To assist users in making accurate cuts, many table saws are adapted to mount work piece or material guides.

One type of guide commonly found on table saws is the rip fence. Rip fences are table saw guides that assist users in making lengthwise cuts through material. Most rip fences traverse the table parallel to the cutting direction of the blade. In order to make cuts of varying work piece width, a user slides the fence closer to or farther from the blade. To ensure an accurate cut is made the fence should be securely fastened at a precise orientation with respect to the blade.

A clamping system is commonly used to secure the rip fence with respect to the blade. The clamping system secures the fence to a guide mounted on the edge of the table. The guide extends perpendicularly to the cutting direction of the blade and often traverses the entire width of the table or even wider than the table. Previously known rip fence clamping systems utilize a rip fence that slides along a guide mounted on the side of the table proximal the user. When the user places the fence in the desired position he or she engages a clamp that secures the end of the fence proximal the user to the guide or, in some instances, at the rear of the fence. These clamping arrangements adequately secure the fence to the table, but some users may find it advantageous to have an arrangement that provides additional clamping force.

In view of the foregoing, it would be advantageous to provide a guide assembly for a table saw where the guide assembly provides increased clamping force. It would also be advantageous if the guide assembly could be easily secured to the table. Furthermore, it would be advantageous if the guide assembly could be automatically oriented with respect to the blade. An additional benefit would be if the guide assembly remained oriented with respect to the blade both when clamped and when being moved. It would be further advantageous if movement of the guide assembly could be accomplished in a smooth manner.

SUMMARY

In accordance with one embodiment of the disclosure, a guide assembly includes at least one guide rigidly supported by a table saw, a bearing assembly including a first, a second, and a third bearing engaged with the at least one guide, and a fence base assembly supported by the bearing assembly, wherein the first and the second bearings are biased in a first direction with respect to the at least one guide and the third bearing is biased in a second direction with respect to the at least one guide, the second direction at least partially opposite to the first direction.

In another embodiment, a guide assembly includes a clamp bar fixedly positioned with respect to a table saw, a first spring plate releasably engageable with the clamp bar, and a cam lock configured to selectively bias the first spring plate toward a first side of the clamp bar.

DESCRIPTION

Figure 1:
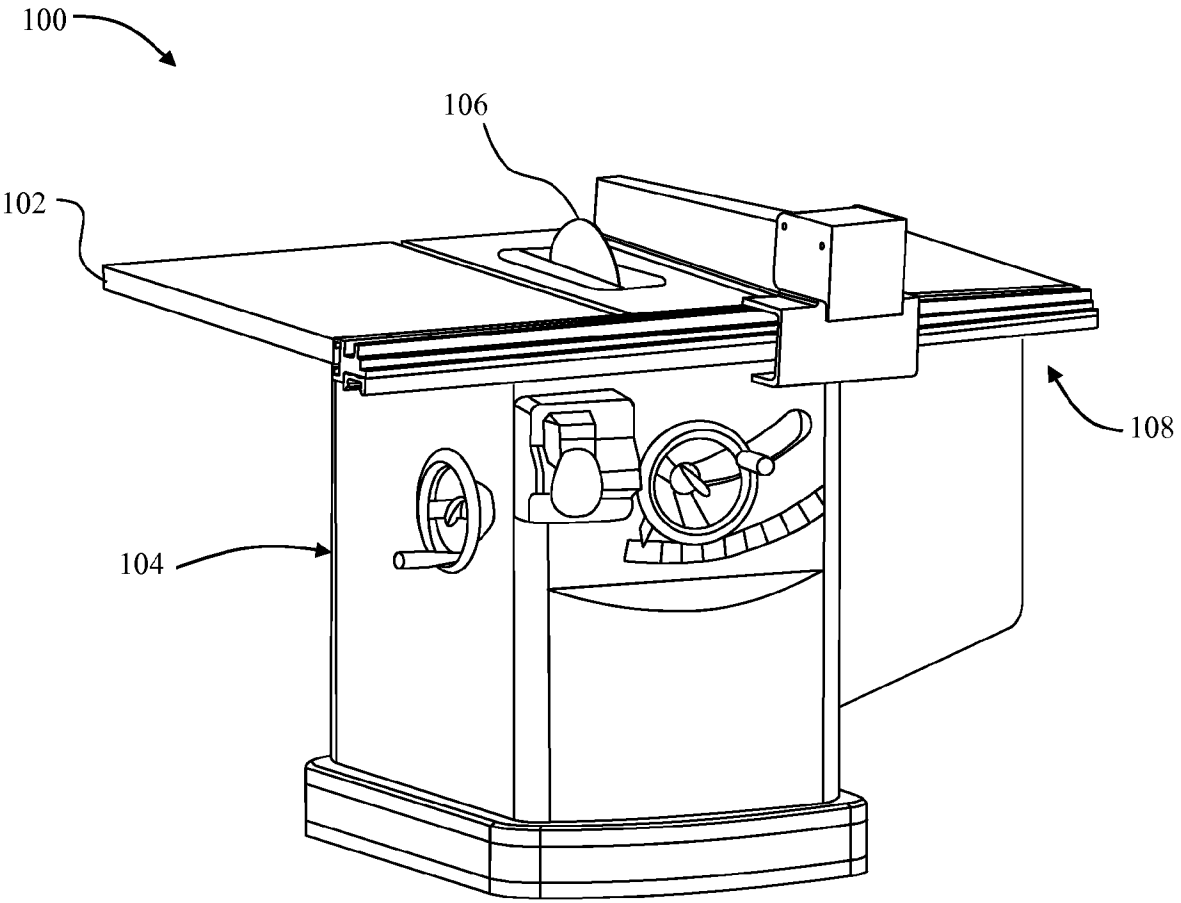
FIG. 1 depicts a perspective view of a table saw including a guide assembly with a rip fence in accordance with principles of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the invention includes any alterations and modifications to the illustrated embodiments and includes further applications of the principles of the invention as would normally occur to one skilled in the art to which this invention pertains.

FIG. 1 depicts a table saw 100 which includes a work support surface 102, a base assembly 104, a blade 106 and a guide assembly 108. The guide assembly 108, also shown in FIG. 2, includes a fence 110, a base assembly 112, and a rail assembly 114. The fence 110 in some embodiments extends completely across the work support surface 102. In other embodiments, the fence 110 is shorter and extends in further embodiments just to the middle of the blade 106. In some embodiments the fence 110 may be movably attached at both ends to the work support surface 102 or other portion of the table saw 100.

Figure 2:
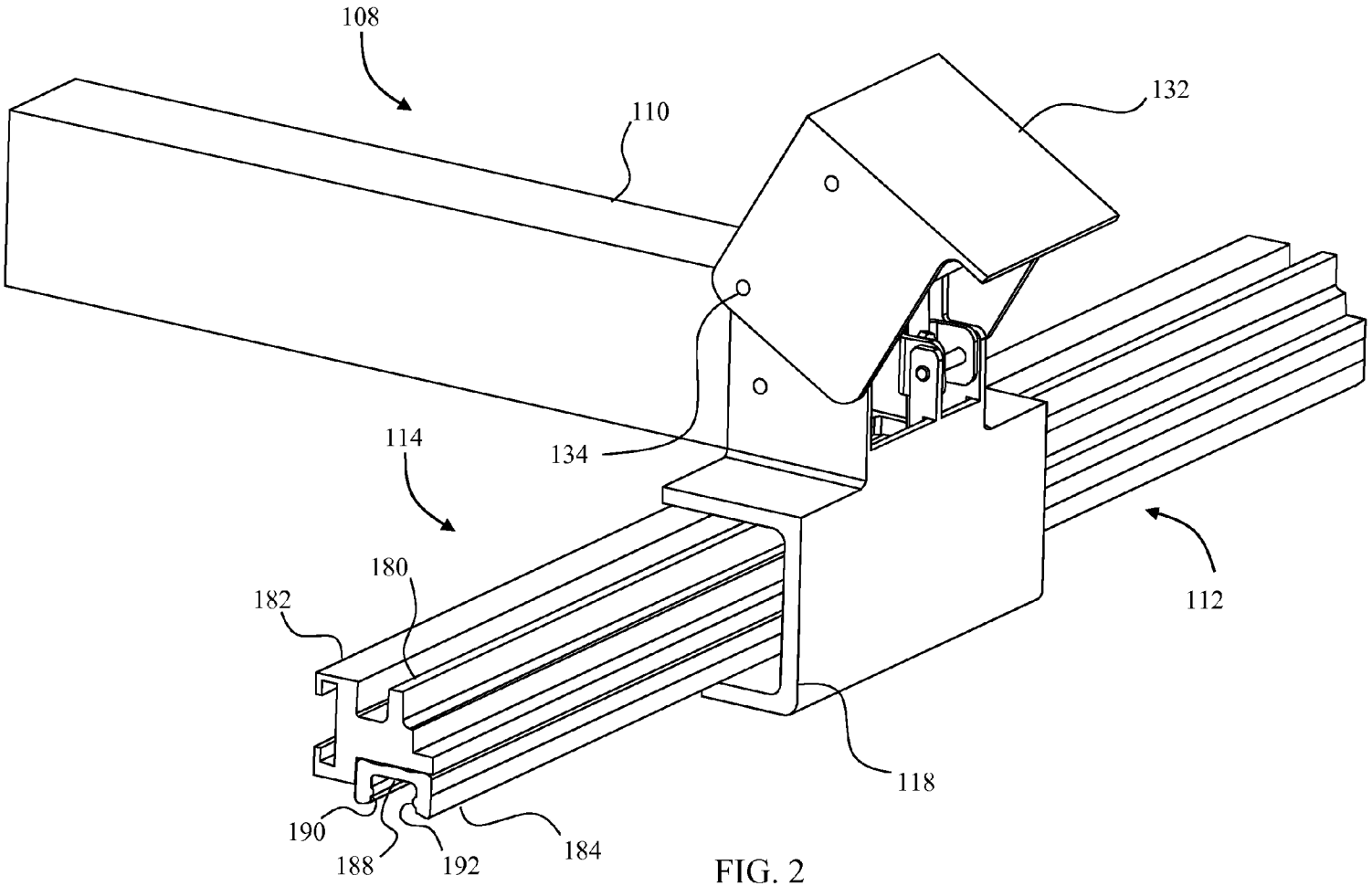
FIG. 2 depicts a partial top perspective view of the guide assembly of FIG. 1 in an unlocked position.
Figure 3:
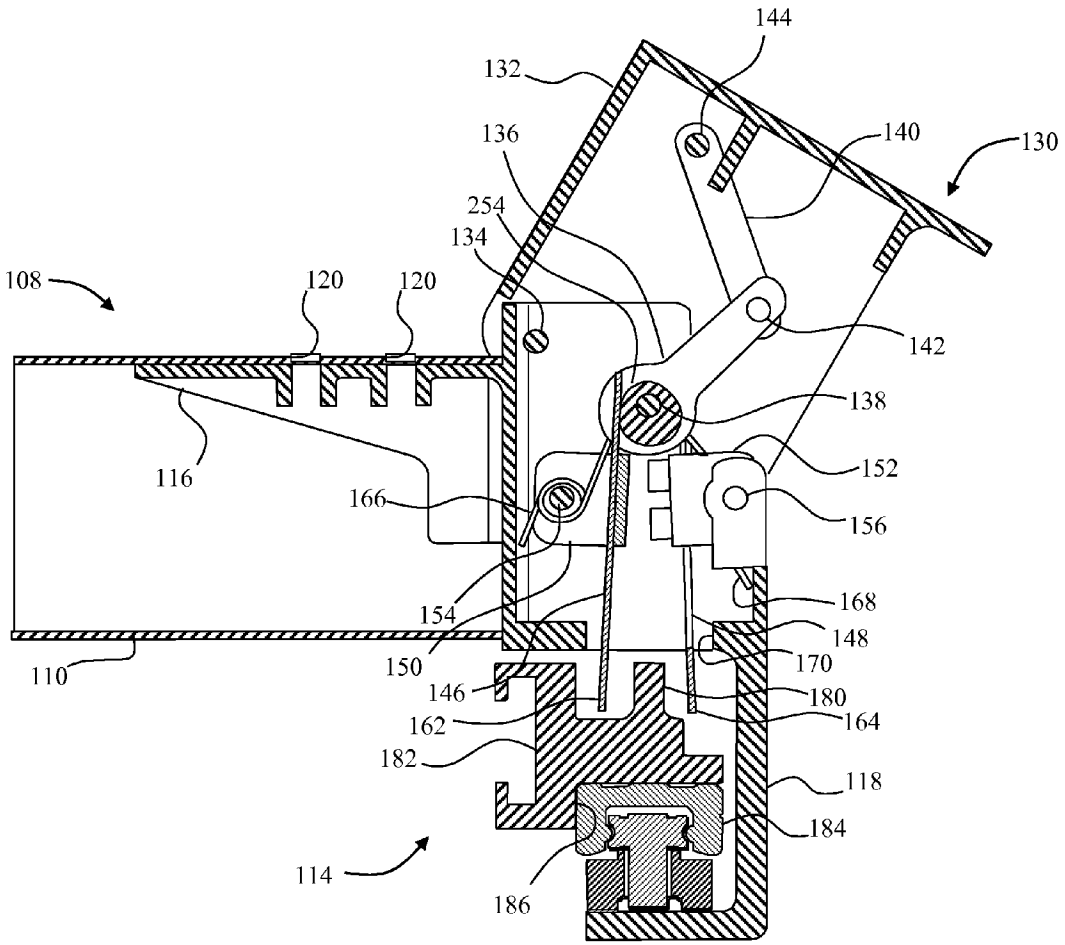
FIG. 3 depicts a side cross sectional view of the guide assembly of FIG. 2.
Figure 4:
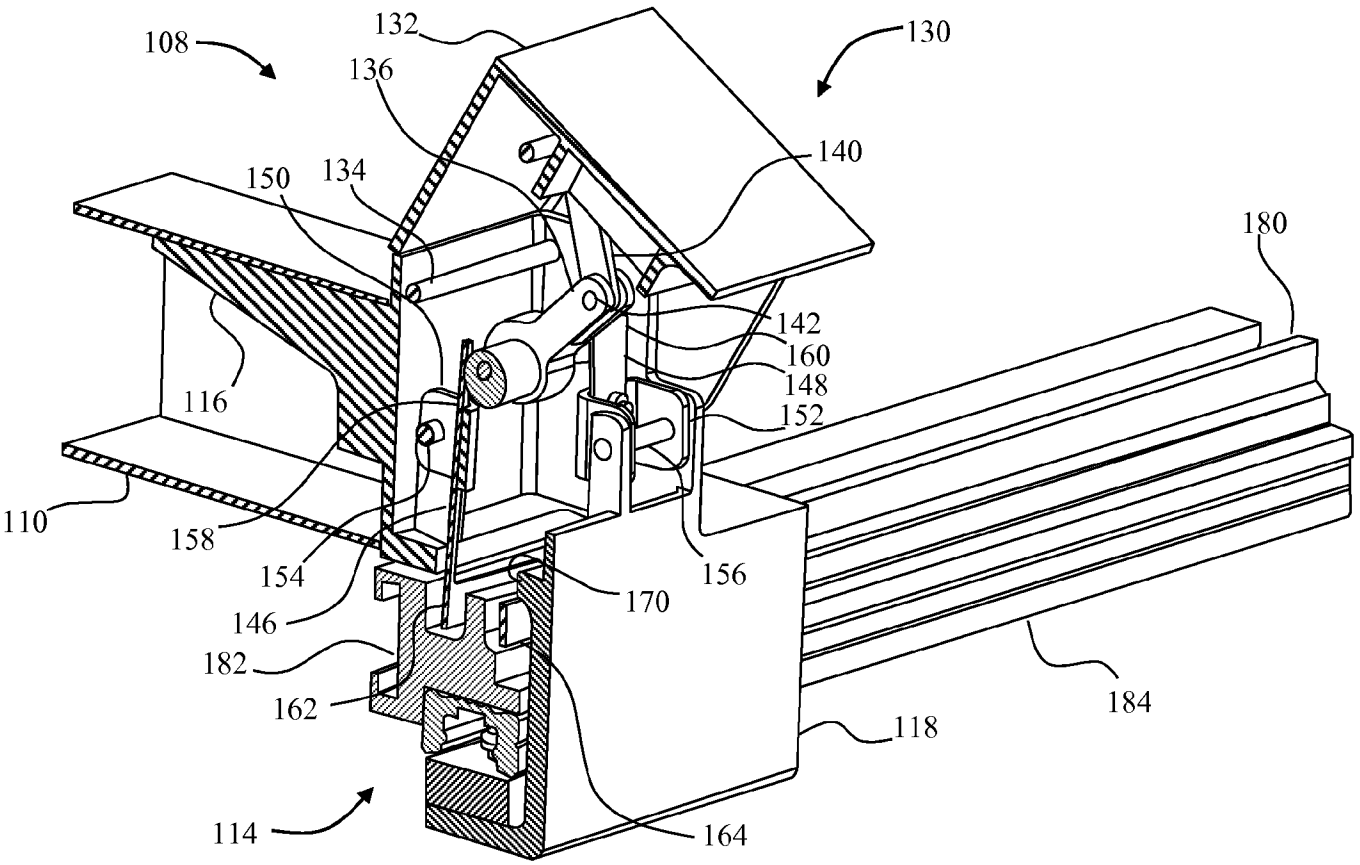
FIG. 4 depicts a partial cross sectional perspective view of the guide assembly of FIG. 2.

Referring additionally to FIGS. 3 and 4, the fence 110 is rigidly supported by a bracket 116 which is part of a base portion 118 of the base assembly 112. In this embodiment, the fence 110 is removably attached to the bracket 116 using bolts (not shown) inserted through bolt holes 120 (see FIG. 2). If desired, the fence 110 may be permanently attached to the base portion 118 or removably attached using other desired attachment devices.

The base assembly 112 further includes a locking assembly 130 which includes an actuator or handle 132 pivotably attached to the base portion 118 by a pivot pin 134. A cam lock (lever) 136 is rotatably attached to the base portion 118 by a pin 138. The cam lock 136 is hingedly attached to the actuator 132 through a knee hinge arrangement including a linkage 140 and two pivot pins 142 and 144.

Two spring plates 146 and 148 are hingedly supported by the base portion 118 by a respective bracket 150 and 152 and pin 154/156 assembly. The spring plates 146/148 include a lever arm portion 158/160 and a brake portion 162/164. In some embodiments, the brake portions are configured to increase friction with a clamp bar 180, such as by addition of a frictional material or by roughening the surface of the brake portions 162/164. The lever arm portions 158/160 are biased into contact with the cam lock 136 by respective springs 166 and 168. In the configuration of FIG. 3, the springs 166 and 168 bias the brake portions 162/164 away from a clamp bar 180 (see below) so that the fence 110 can be moved along the work support surface 102.

As shown in FIGS. 3 and 4, the lever arm portions 158 and 160 extend through an opening 170 in the base portion 118 and brake portions 162 and 164 are spaced apart from a clamp bar 180 of the rail assembly 114. The rail assembly 114 further includes a base portion 182 and a guide portion 184. The base portion 182 is configured to be mounted along one side of the work support surface 102 such that the clamp bar 180 extends along the side of the work support surface 102 perpendicular to the plane defined by the blade 106 when the blade 106 is perpendicular to the work support surface 102. The base portion 182 may extend along the entire side of the work support surface 102 or only partially along the work support surface 102, or beyond the end of the work support surface 102.

The base portion 182 includes a mounting portion 186 which in this embodiment is located opposite to the clamp bar 180. The guide portion 184 is fixedly attached to the mounting portion 186. In other embodiments, the guide portion 184 is integrally formed with the base portion 182. The guide portion 184 includes a guide cavity 188 (see FIG. 2). Two guides 190 and 192 are defined by the guide cavity 188. The guides 190 and 192 may be integrally formed with the guide portion 184 or separately formed and attached to the guide portion 184.

Figure 5:
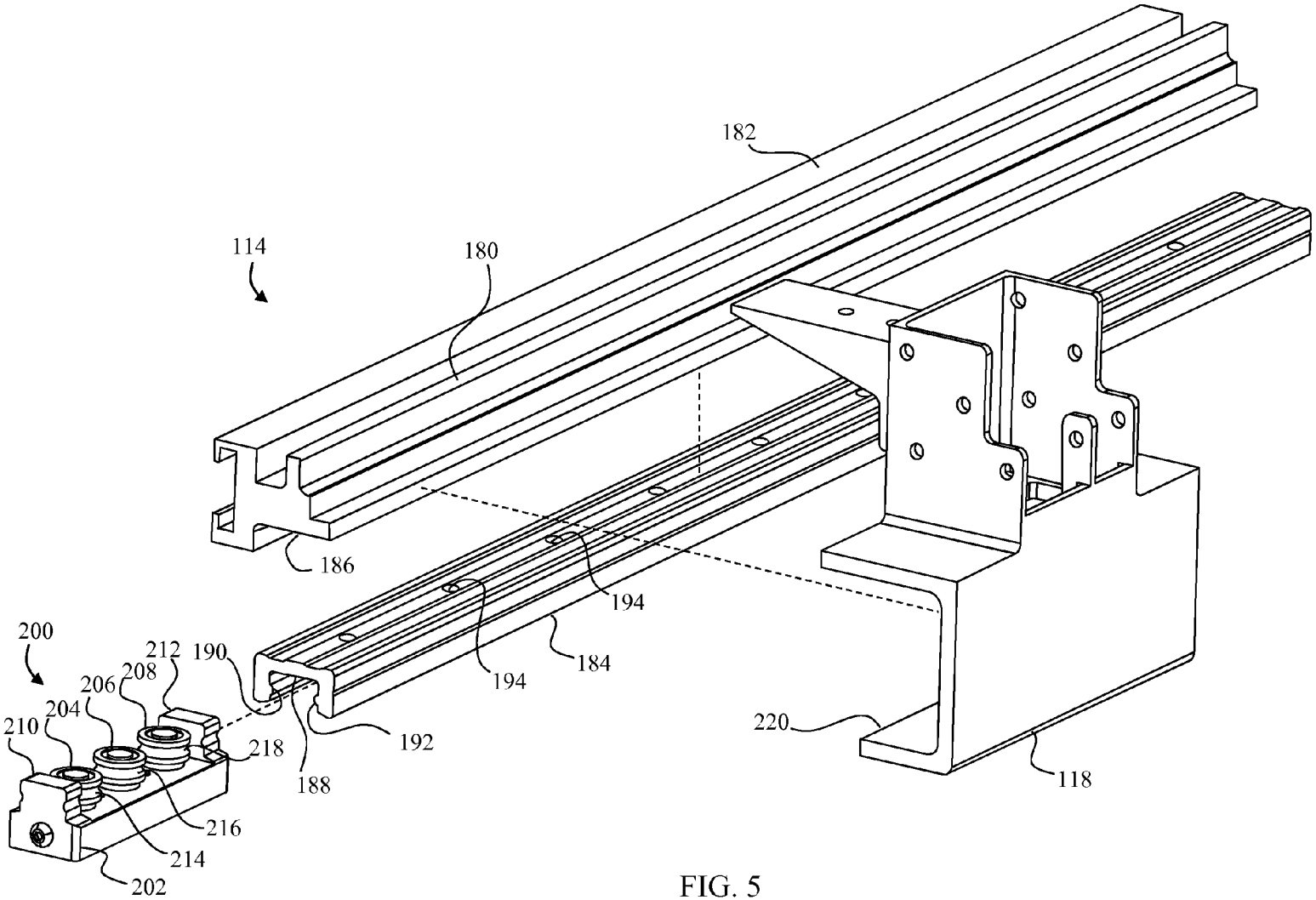
FIG. 5 depicts a perspective exploded view of the rail assembly, base portion, and roller bearing carriage of the guide assembly of FIG. 2.

Additional detail and assembly of the guide assembly 108 is provided with further reference to FIG. 5. Initially, the guide portion 184 is mounted to the mounting portion 186 of the base portion 182 using mounting holes 194. Next, a bearing assembly 200 is inserted into the guide cavity 188.

The bearing assembly 200 includes a carriage 202 and three roller bearings 204, 206, and 208. End caps 210 and 212 extend from the carriage 202. The roller bearings 204, 206, and 208 and the end caps 210 and 212 are configured to fit within the guide cavity 188. When positioned within the guide cavity 188, the end caps 210 and 212 inhibit dust and other contaminants from reaching the roller bearings 204, 206, and 208 which are rotationally mounted in the carriage 202. In some embodiments, the end caps 210 and 212 are omitted. Grooves 214, 216, and 218 in the respective roller bearings 204, 206, and 208 engage the guides 190 and 192. While each of the roller bearings 204, 206, and 208 engage both of the guides 190 and 192 in one embodiment, the roller bearings 204 and 208 are biased slightly toward the guide 192 while the roller bearing 206 is biased slightly toward the guide 190. In one embodiment, the roller bearings 204, 206, and 208 are set by set screws (not shown) to establish the desired bias.

Figure 6:
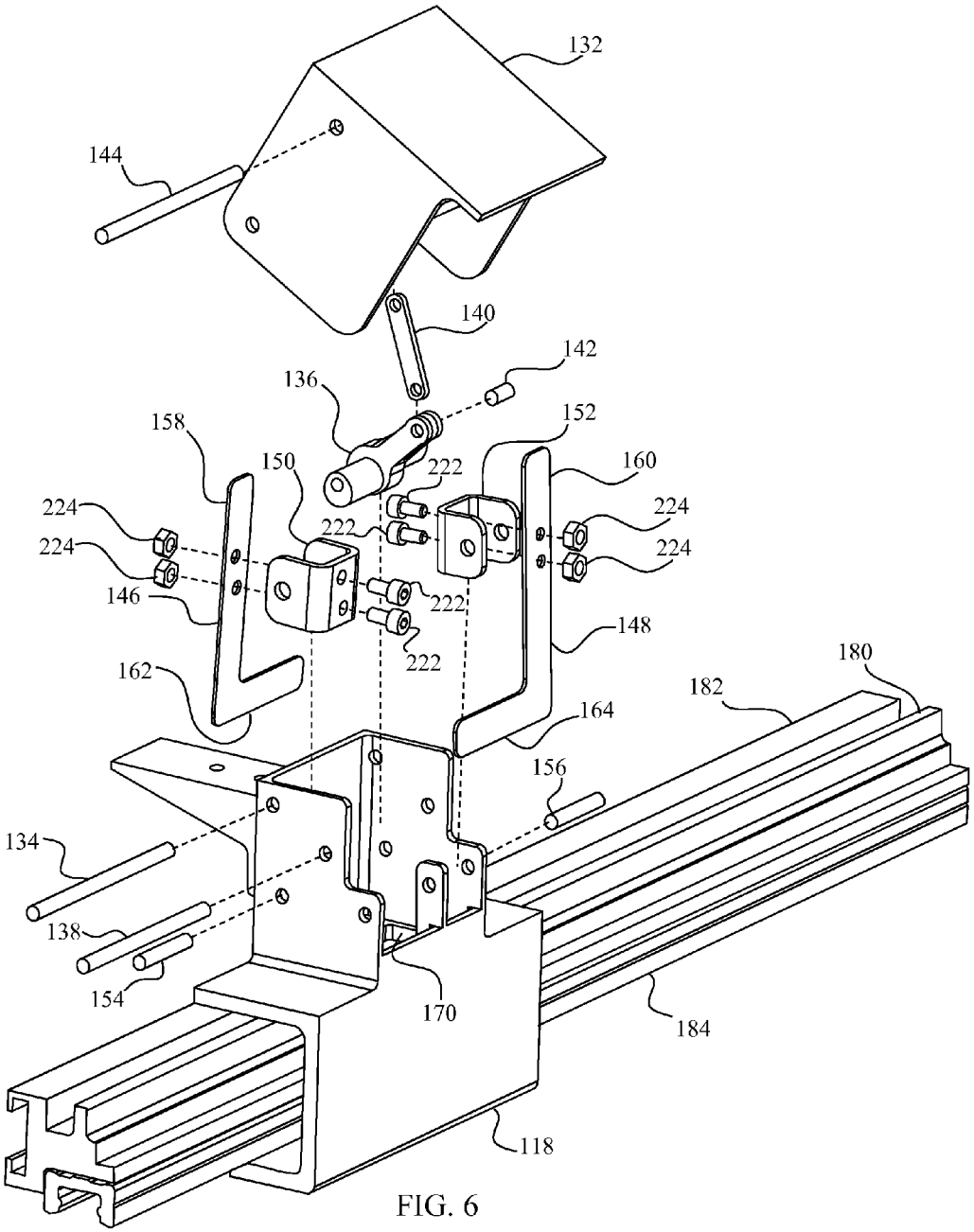
FIG. 6 depicts a perspective partial exploded view of the rail assembly of FIG. 2.

Once the bearing assembly 200 is positioned within the guide cavity 188, a bottom flange 220 of the base portion 118 is attached to the bottom of the carriage 202 resulting in the configuration of FIG. 6. The brackets 150/152 are connected to the respective spring plates 146/148 bolts 222 and nuts 224 and the connected brackets 150/152 and spring plates 146/148 are then lowered into the base portion 118 such that the brake portions 162/164 go through the opening 170 (see also FIGS. 3 and 4) to a location adjacent to the clamp bar 180. Pins 154 and 156 are then used to pivotably mount the brackets 150/152 and springs 166/168 (see FIG. 3) to the base portion 118.

Next, a knee hinge is formed using the pin 142 to hingedly connect the linkage 140 and the cam lock 136 and the pin 144 is used to hingedly connect the linkage 140 to the actuator 132. The actuator 132, linkage 140 and cam lock 136 are then lowered so as to position the cam lock 136 between the lever arm portions 158/160 of the spring plates 146/148 (see also FIG. 3). The pin 138 is then used to rotatably attach the cam lock 136 to the base portion 118 and the pin 134 is used to pivotably attach the actuator 132 to the base portion 118.

Assembly of the guide assembly 108 is completed by attaching the fence 110 to the bracket 116 resulting in the configuration of FIG. 2. While bolts through the bolt holes 120 are used in this embodiment, other configurations may be used to mount the fence 110 in embodiments with a removable Fence. One such embodiment incorporates a slot in the fence guide profile and a wing knob and square neck bolt fixed by a hole in the fence main base to allow for removable securing of the fence so that the fence 110 can be easily moved to the other side of the blade 106.

Once the guide assembly 108 is assembled, the fence 110 is forced into a predetermined alignment because two of the roller bearings (204 and 208) are biased toward the guide 192 and the other roller bearing (206) is biased toward the other guide 190. Because the roller bearings 204 and 208 are biased in a direction opposite or at least somewhat opposite to the bearing 206, clearance in the system is eliminated. This loaded condition of the roller bearings 204, 206, and 208 allows the roller bearings to force the fence 110 to a desired alignment based on the guide 184 and helps with smooth travel of the base portion 118 along the rail assembly 114.

Operation of the guide assembly 108 once assembled and mounted at a location adjacent to the work support surface 102 is described with initial reference to FIG. 3. In FIG. 3, the actuator 132 is in a raised position and the cam lock 136 is in an unlocked position. As discussed in more detail below, this configuration results in the brake portions 162 and 164 being spaced apart from the clamp bar 180. Accordingly, the base portion 118 may be moved along the rail assembly 114. Smooth movement of the base portion 118 along the rail assembly 114 is provided by the offset roller bearings 204, 206, and 208.

Specifically, because the roller bearings 204, 206, and 208 are offset in or biased toward at least partially opposite directions, the carriage 202, and thus the base portion 118, is firmly held in a predetermined orientation. The predetermined orientation may be established during manufacture of the guide assembly 108 and attachment of the guide assembly 108 to the table saw 100 such that the fence 110 is maintained in a plane parallel to the plane defined by the blade 106 when the blade 106 is at a ninety degree angle to the work support surface 102.

Accordingly, the base portion 118 may be maneuvered until the fence 110 is at a desired location, with the set roller bearings 204, 206, and 208 maintaining the fence 110 in the predetermined orientation with respect to the work support surface 102 throughout the movement. While the fence 110 is only connected to the base portion 118 in the embodiment of FIG. 1, the fence 110 may be connected through additional rollers to the side of the work support surface 102 opposite to the side on which the rail assembly 114 is mounted. The "rear" bearing system in this embodiment may "float" to provide a tolerance between the two rail systems. The rear bearing(s) may be mounted in a plane vertical to the plane defined by the work support surface 102 to aid in fence movement. A clamp (not shown) may also be provided at the rear of the fence 110.

Figure 7:
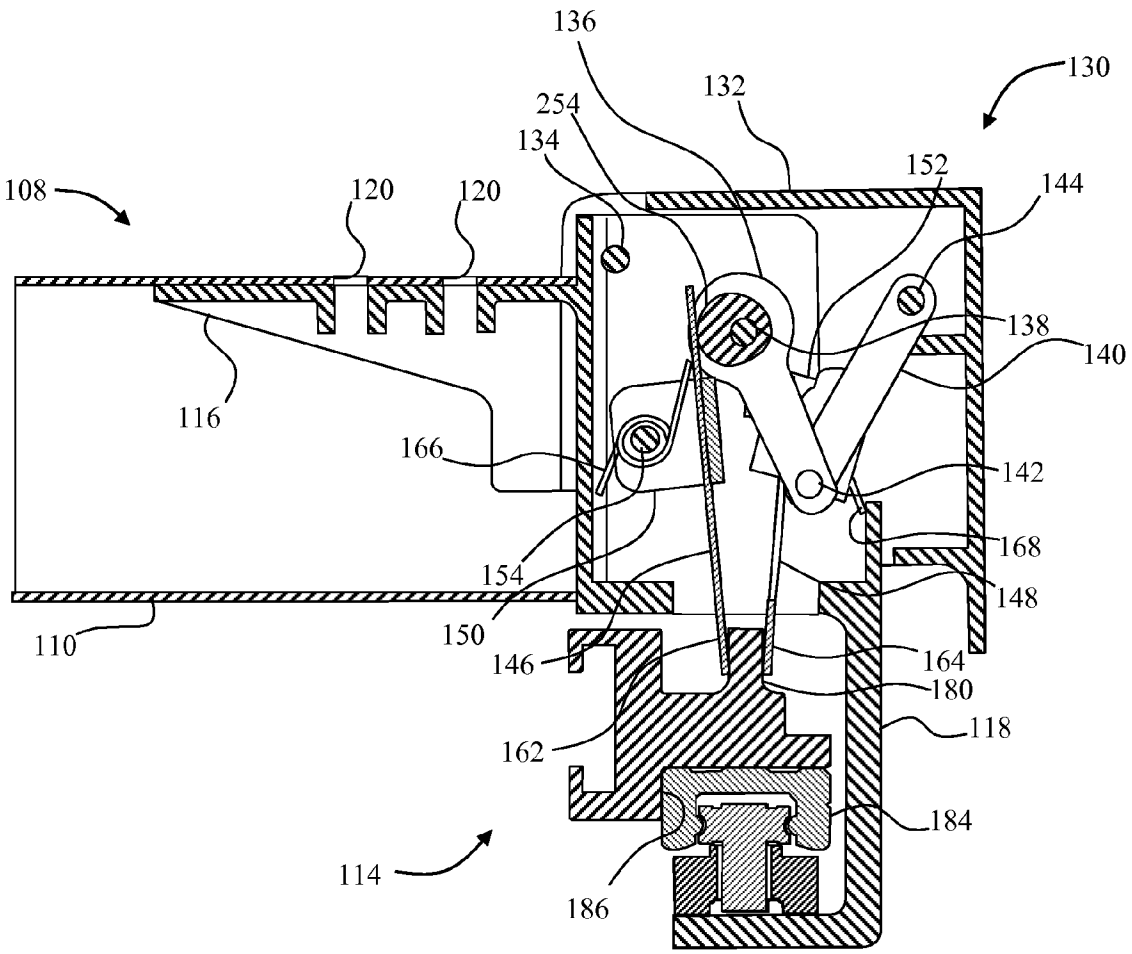
FIG. 7 depicts a partial side cross sectional view of the guide assembly of FIG. 1 in a locked position.

Once the fence 110 is at the desired location, the base portion 118 may be locked with respect to the rail assembly 114 simply by rotating the actuator 132 in a clockwise direction from the position depicted in FIG. 3 to the position depicted in FIG. 7. Rotation of the actuator 132 from the location of FIG. 3 to the location of FIG. 7 causes the brake portions 162 and 164 to clamp the clamp bar 180 because of the configuration of the cam lock 136.

Figure 8:
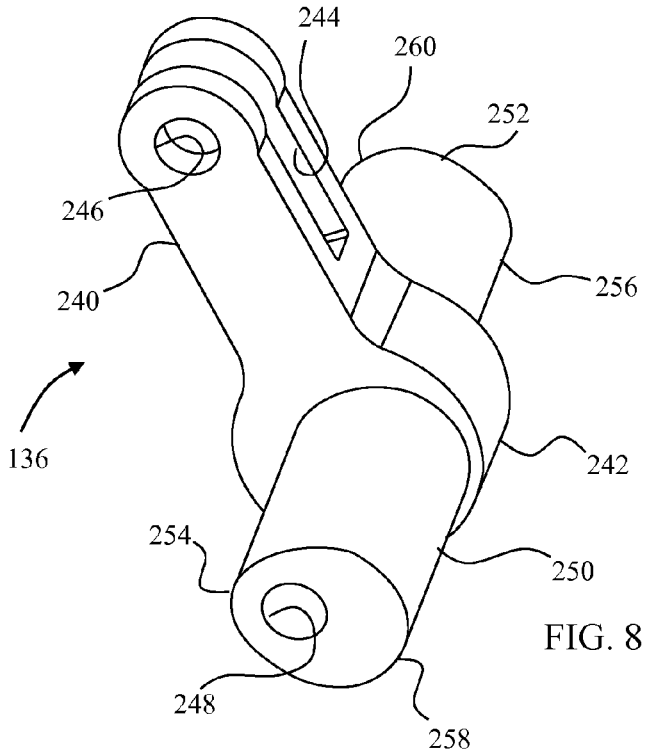
FIG. 8 depicts a perspective view of the cam lock of the guide assembly of FIG. 2.
Figure 9:
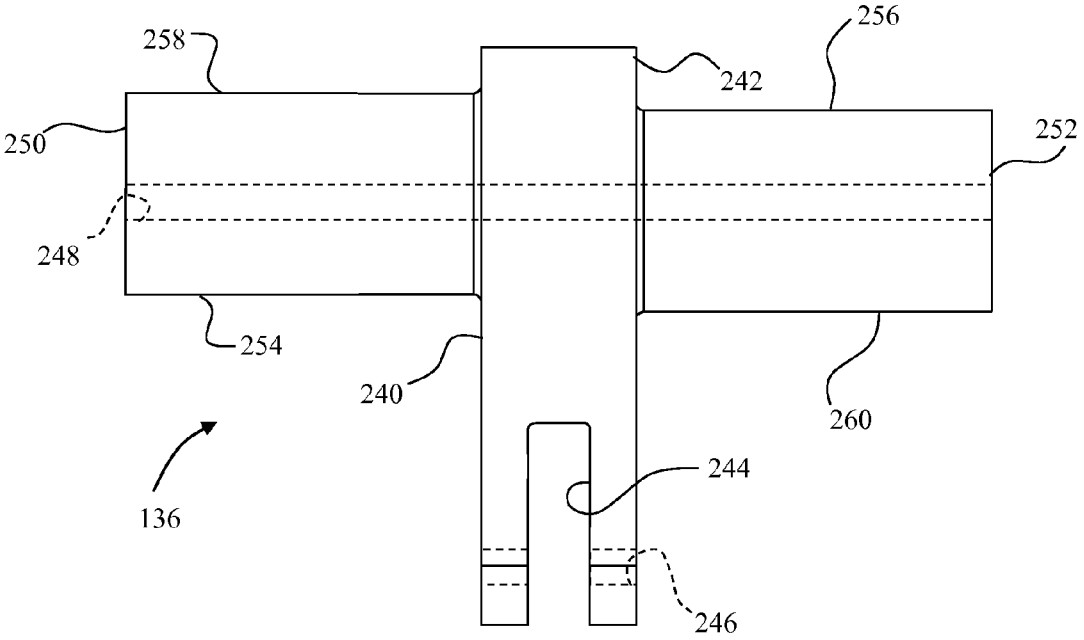
FIG. 9 depicts a plan view of the cam lock of the guide assembly of FIG. 2.

Specifically, the cam lock 136, shown in further detail in FIGS. 8 and 9, includes a neck 240 and a body 242. The neck includes a slot 244 configured to receive the linkage 140 therein and a bore 246 configured to receive the pin 142. A bore 248 extends through the body 242 which includes two camming portions 250 and 252. The bore 248 is configured to receive the pin 138.

The camming portions 250 and 252 are not centered with respect to the bore 248. Consequently, each camming portion 250/252 has a respective shallow wall portion 254/256 and deep wall portion 258/260. The cam lock 136 is configured such that the camming portions 250 and 252 are offset with respect to each other. Accordingly, even though the spring plate 146 is located rearwardly of the cam lock 136 while the spring plate 148 is located forwardly of the cam lock 136 (see FIG. 3), when the cam lock 136 is positioned as depicted in FIG. 3, the short wall portions 254 and 256 are located adjacent to the respective spring plates 146 and 148. The cam lock 136 in one embodiment is an "over center" type cam. Accordingly, once rotated to a locked position (see below), the cam lock 136 will not open or rotate back to an unlocked state on its own.

As the actuator 132 is rotated in a clockwise direction from the position of FIG. 3 to the position of FIG. 7, the cam lock 136 is force to rotate about the pin 138 in a clockwise direction by the linkage 140. As the cam lock 136 rotates in a clockwise direction, the deep wall portion 258 is rotated toward the spring plate 146 while the deep wall portion 260 is rotated toward the spring plate 148. The increase in effective diameter of the cam lock 136 between the spring plates 146/148 compresses the springs 166/168 (see FIG. 3), and pivots the spring plate 146 and bracket 150 in a counter-clockwise direction while pivoting the spring plate 148 and bracket 152 in a clockwise direction. Accordingly, the brake portions 162 and 164 are rotated against opposite sides of the clamp bar 180, thereby locking the base portion 118 on the rail assembly 114. The force applied is equal and opposite. This prevents applying a moment to the assembly which could result in twisting thereby reducing accuracy.

When the operator desires to move the fence 110 to a new location, the actuator 132 is rotated in a counter-clockwise direction from the position of FIG. 7 to the position of FIG. 3, thereby unlocking the base portion by reversal of the above described sequence.

As depicted in FIG. 5, the roller bearings 204, 206, and 208 are a Gothic arch shape located within a cavity underneath the clamp bar 180, but other configurations may be used. Other configurations include ball bearings fixed inside a roller assembly or having the roller assembly as an outer race of the bearing. The roller bearings can be a V-shape or other desired shape. In some embodiments, the roller bearings ride on a rail system that has a generally curved shape. The roller assembly may be plastic or another desired material.

Moreover, while the rail assembly 114 of FIG. 2 includes two steel bars mounted to an aluminum U-shaped extrusion, in other embodiments the rail assembly is an extruded part with a bearing raceway impregnated onto the surface or just a rolled piece of steel sheet metal mounted to the extruded part.

In yet another embodiment, a bearing carriage is a feature on the fence base and not a separate part. Moreover, the roller bearings may be replaced by or more linear bearings. In linear bearing embodiments, the rail may be a round solid or hollow tube shape supported at either end, or fixed along its length. The linear bearings may be "C" shaped or "open" if the rail is fixed along its length.

Consequently, while the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

The invention claimed is:

1. A table saw guide assembly, comprising:

a rail including a base portion and a guide portion and rigidly supported by a table saw, the guide portion including a guide cavity defining two guides, the two guides arranged opposing one another and rigidly supported by the table saw;

a bearing assembly including a first, a second, and a third bearing engaged with the guide portion; and a fence base assembly supported by the bearing assembly, wherein the first and the second bearings are biased in a first direction with respect to the guide portion and the third bearing is biased in a second direction with respect to the guide portion, the second direction at least partially opposite to the first direction.

2. The guide assembly of claim 1, wherein the first and second bearings are biased toward a first of the two guides and the third bearing is biased toward a second of the two guides.

3. The guide assembly of claim 2, further comprising:

a fence removably connected to the fence base assembly.

4. The guide assembly of claim 1, wherein:

the rail further comprises a clamp bar; and the fence base assembly includes a first spring plate releasably engageable with the clamp bar.

5. The guide assembly of claim 4, further comprising:

a cam lock configured to selectively bias the first spring plate toward a first side of the clamp bar.

6. The guide assembly of claim 5, further comprising:

a second spring plate, wherein the cam lock is further configured to selectively bias the second spring plate toward a second side of the clamp bar.

7. The guide assembly of claim 5, wherein the cam lock is hingedly connected to a cam lock actuator.

8. The guide assembly of claim 7, wherein the cam lock actuator is pivotably connected to a fence base portion.

9. A guide assembly comprising:

a clamp bar fixedly positioned with respect to a table saw and extending along one side of the table saw;

a first spring plate releasably engageable with the clamp bar;

a second spring plate releasably engageable with the clamp bar; and a cam lock configured to selectively bias the first spring plate toward a first side of the clamp bar and to selectively bias the second spring plate toward a second side of the clamp bar, wherein the cam lock is hingedly connected to a cam lock actuator, wherein the cam lock actuator is pivotably connected to a fence base portion, wherein the first spring plate is pivotably connected to the fence base portion, and wherein the second spring plate is pivotably connected to the fence base portion.

10. A guide assembly comprising:

a clamp bar fixedly positioned with respect to a table saw;

a first spring plate releasably engageable with the clamp bar;

a second spring plate releasably engageable with the clamp bar;

a cam lock configured to selectively bias the first spring plate toward a first side of the clamp bar and to selectively bias the second spring plate toward a second side of the clamp bar;

a rail defining the clamp bar and fixedly attached to the table saw;

a pair of opposing guides rigidly supported by the rail; and a bearing assembly including a first, a second, and a third bearing engaged with the pair of opposing guides, wherein the first and the second bearing are biased toward a first of the pair of opposing guides and the third bearing is biased toward a second of the pair of opposing guides.

11. The guide assembly of claim 10, further comprising:

a fence removably connected to the fence base portion.

12. The guide assembly of claim 10, wherein the rail includes a guide cavity defining the pair of opposing guides.

13. The guide assembly of claim 12, wherein the rail includes a base portion and a guide portion, the guide portion including the guide cavity and fixedly attached to the base portion.

* * * * *